US009743193B2

(12) United States Patent
López Castillo

(10) Patent No.: US 9,743,193 B2
(45) Date of Patent: Aug. 22, 2017

(54) SELF-COOLING LOUDSPEAKER

(71) Applicant: Tymphany Hong Kong Ltd, Wanchai (HK)

(72) Inventor: Jorge Alejandro López Castillo, Alicante (ES)

(73) Assignee: TYMPHANY HONG KONG LTD., East Wanchai (HK)

( * ) Notice: Subject to any disclaimer, the term of this patent is extended or adjusted under 35 U.S.C. 154(b) by 0 days.

(21) Appl. No.: 14/872,494

(22) Filed: Oct. 1, 2015

(65) Prior Publication Data

US 2017/0099547 A1 Apr. 6, 2017

(51) Int. Cl.

| | |
|---|---|
| ***H04R 1/00*** | (2006.01) |
| ***H04R 9/02*** | (2006.01) |
| ***H04R 9/06*** | (2006.01) |

(52) U.S. Cl.

CPC ..... *H04R 9/022* (2013.01); *H04R 9/025* (2013.01); *H04R 9/06* (2013.01)

(58) Field of Classification Search

CPC ..... H04R 9/022; H04R 9/043
USPC ..... 381/397
See application file for complete search history.

(56) References Cited

U.S. PATENT DOCUMENTS

| | | | | |
|---|---|---|---|---|
| 5,734,734 | A * | 3/1998 | Proni | H04R 9/02 381/400 |
| 6,771,791 | B2 * | 8/2004 | Shelley | H04R 9/022 381/397 |
| 6,837,333 | B2 * | 1/2005 | Howze | H04R 9/022 181/148 |
| 7,360,626 | B2 * | 4/2008 | Sahyoun | H04R 7/122 181/163 |
| 7,684,585 | B2 * | 3/2010 | Kemmerer | H04R 9/022 361/690 |
| 2001/0031063 | A1 * | 10/2001 | Langford | H04R 9/022 381/397 |

FOREIGN PATENT DOCUMENTS

| | | | | |
|---|---|---|---|---|
| BE | WO 2008093238 | A2 * | 8/2008 | H04R 9/022 |

* cited by examiner

*Primary Examiner* — Curtis Kuntz
*Assistant Examiner* — Ryan Robinson
(74) *Attorney, Agent, or Firm* — Cantor Colburn LLP

(57) ABSTRACT

A self-cooling loudspeaker including a frame, a diaphragm portion connected to the frame via a surround, an elastic member connected to the frame, a voice coil connected to the diaphragm portion, a magnet assembly connected to the frame, and first and second airflow control members disposed therein for regulating flows generated by the loudspeaker during sound reproduction, where the first and second airflow control members regulate the amount of cool air flowing into the loudspeaker and hot air flowing out.

7 Claims, 3 Drawing Sheets

SELF-COOLING LOUDSPEAKER

FIELD OF THE INVENTION

The present invention relates to speaker structure and more particularly, to a self-cooling loudspeaker, which has airflow control members and air passages for airflows.

BACKGROUND OF THE INVENTION

When a loudspeaker works reproduces a sound via a voice coil built therein, the voice coil becomes a source of heat in the loudspeaker. The voice coil heats up as the electric current flows through. Part of the heat generated by the voice coil is transferred to the air and other members of the loudspeaker around the voice coil. Materials of which the members of the loudspeaker are made exhibit a poor thermal conductivity, e.g. the magnetic members of the loudspeaker. As the heat transfers to these members, the heat is not effectively liberated but it is rather stored in these members over time.

The heat stored in these members of the loudspeaker increases the temperature of the loudspeaker. The high temperature handled by the loudspeaker during sound reproduction may cause critical issues, such as high power compression, demagnetization of the magnet members, and moreover it can damage some of the members of the loudspeaker leading to a severe loudspeaker failure.

A solution for this problem is to equip extra pieces made of material having good thermal conductivity, such as aluminum, to the loudspeaker in strategic places, and with specific shapes, so that the efficiency of heat dissipation in the loudspeaker increases. These pieces are so called heat sinks.

Heat sinks help dissipate heat, however, in some circumstances this is not enough and the heat released by the heat sinks into the adjacent air needs also to be moved, so that the temperature in the loudspeaker can be further reduced.

Apart from choosing materials which can handle high temperature, another conventional solution that can help the loudspeaker to achieve a good power handing is to pierce the structure of the loudspeaker at specific areas so that the hot air can be released from cavities of the loudspeaker. However, the expelled hot air stays in the surroundings of the loudspeaker. The hot air that was removed may come back into the loudspeaker again without a proper control of the airflows.

BRIEF SUMMARY OF THE INVENTION

The invention provides a self-cooling loudspeaker which can control airflows and the paths of the airflows such that only air from cool regions flow into the loudspeaker while hot air remains outside of the loudspeaker.

More particularly, the invention provides a loudspeaker being capable of self-cooling while reproducing sound. The loudspeaker comprises a frame, a diaphragm portion connected to the frame via a surround, an elastic member connected to the frame, a voice coil connected to the diaphragm portion, a magnet assembly connected to the frame, and first and second airflow control members disposed therein for regulating flows produced during the reproducing sound process.

DETAILED DESCRIPTION OF THE PREFERRED EMBODIMENTS

In order to fully comprehend the features and efficacy of the present invention, a detailed description is described by the following substantial embodiments in conjunction with the accompanying drawings. The description is as below.

Figure 1:
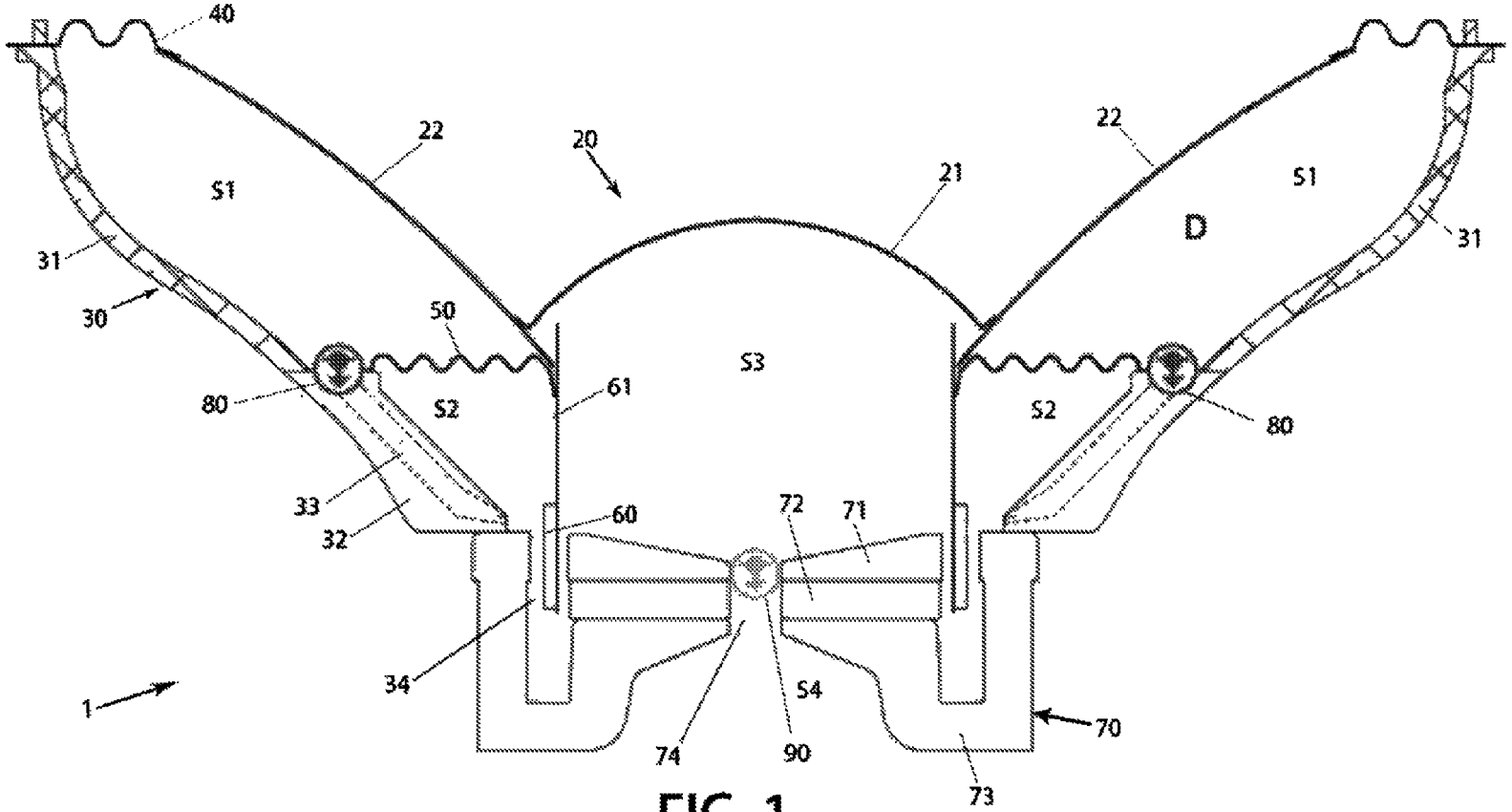
FIG. 1 is a cross-section view of a self-cooling loudspeaker in accordance with an embodiment of the invention.

Referring to FIG. 1, it is a section view of a self-cooling loudspeaker 1 in accordance with the embodiment of the invention. The loudspeaker 1 comprises a frame 30, a diaphragm portion 20 connected to the frame 30 via a surround 40, an elastic member 50 connected to the frame 30, a voice coil 60 connected to the diaphragm portion 20, a magnet assembly 70 connected to the frame 30, and first and second airflow control members 80, 90 disposed therein for regulating flows.

The frame 30 of the loudspeaker 1 as a cartridge may be constructed of a stiff anti-vibrational material, e.g. steel baskets and frames are commonly made of steel or cast aluminum or plastic. The frame 30 includes a first basket 31 and a second basket 32. Along the contour of the second basket 32, there is a second air passage 33 extending from the intersection of the first and second baskets 31, 32 to the magnet assembly 70. The first air flow control member 80 is disposed at one of the distal ends of the second air passage 33 which is near the first basket 31.

The diaphragm portion 20 includes a dome 21 which is adjacent to a cone 22. The dome, also called a dust-cup 21, and cone 22 together form the diaphragm portion 20. The dome 21 and cone 22 can be made by well damped materials such as silk or paper. At the edge of the cone 22, the diaphragm portion 20 is connected to the frame 30 by the surround 40, which could be made from a flexible and fatigue resistant material such as a rubber. Besides, the frame 30 of the loudspeaker 1 is connected to the diaphragm portion 20 by the elastic member 50 which is near the first airflow control member 80 (the elastic member 50 can be connected to the frame 30 by the coil former 61). Conventionally, the elastic member 50 is called a spider. In such a manner, the surround 40 and the elastic member 50 can limit the diaphragm portion 20 to a linear movement relative to the frame 30 of the loudspeaker 1. The linear movement in the FIG. 1 is an upward and downward motion for reproducing sound for a user of the loudspeaker 1. Furthermore, the space surrounded by the cone 22 of the diaphragm portion 20, the first basket 31, and the elastic member 50 is a first region S1 of the loudspeaker 1.

A coil former 61 is connected to the diaphragm portion 20 near the intersection of the cone 22 and dome 21. The voice coil 60 is attached to the coil former 61. The space under the elastic member 50 and surrounded by the elastic member 50, the second basket 32, the coil former 61, and the voice coil 60 is a second region S2 of the loudspeaker 1. Also, the second air passage 33 is in the second region S2.

The magnet assembly 70 of the loudspeaker 1 comprises a top plate 71, a magnet 72, and a yoke portion 73 with a U shape. The magnet 72 is a substantially annular member having a central opening 74 disposed between the top plate 71 and the yoke portion 73. The yoke portion 73 includes a space for the voice coil 60 disposed therein and forms a first air passage 34 which defines an intercommunication between the second region S2 and a third region S3 which extends between the dome 21 of the diaphragm portion 20 and the top plate 71 of the magnet assembly 70.

The second airflow control member 90 is disposed in the central opening 74 of the magnet assembly 70. Under the second airflow control member 90 and the yoke portion 73 of the magnet assemble 70 is a fourth region S4.

In the embodiment, the first and second airflow control members 80, 90 are one-way air valves for regulating the transference of air during sound reproduction from the first region S1 to the fourth region S4. That is, the first airflow control member 80 only allows a flow of air from the first region S1 to the second region S2 via the second air passage 33. The second airflow control member 90 only allows a flow of air from the third region S3 to the fourth region S4 via the central hole 74 of the magnet assembly 70.

Figure 2:
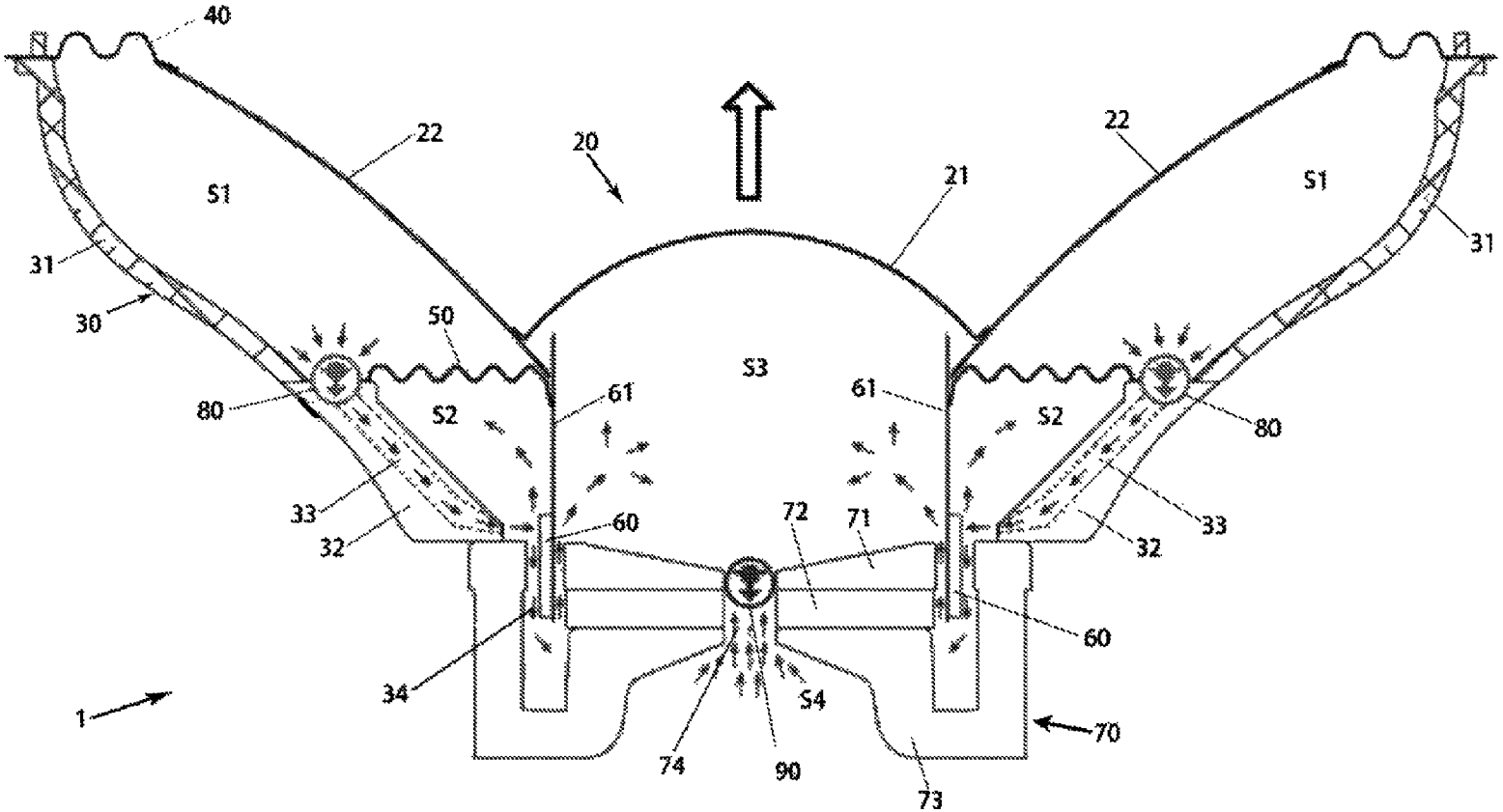
FIG. 2 is a cross-section view of a self-cooling loudspeaker as a diaphragm portion of the loudspeaker during an upward movement in accordance with an embodiment of the invention.
Figure 3:
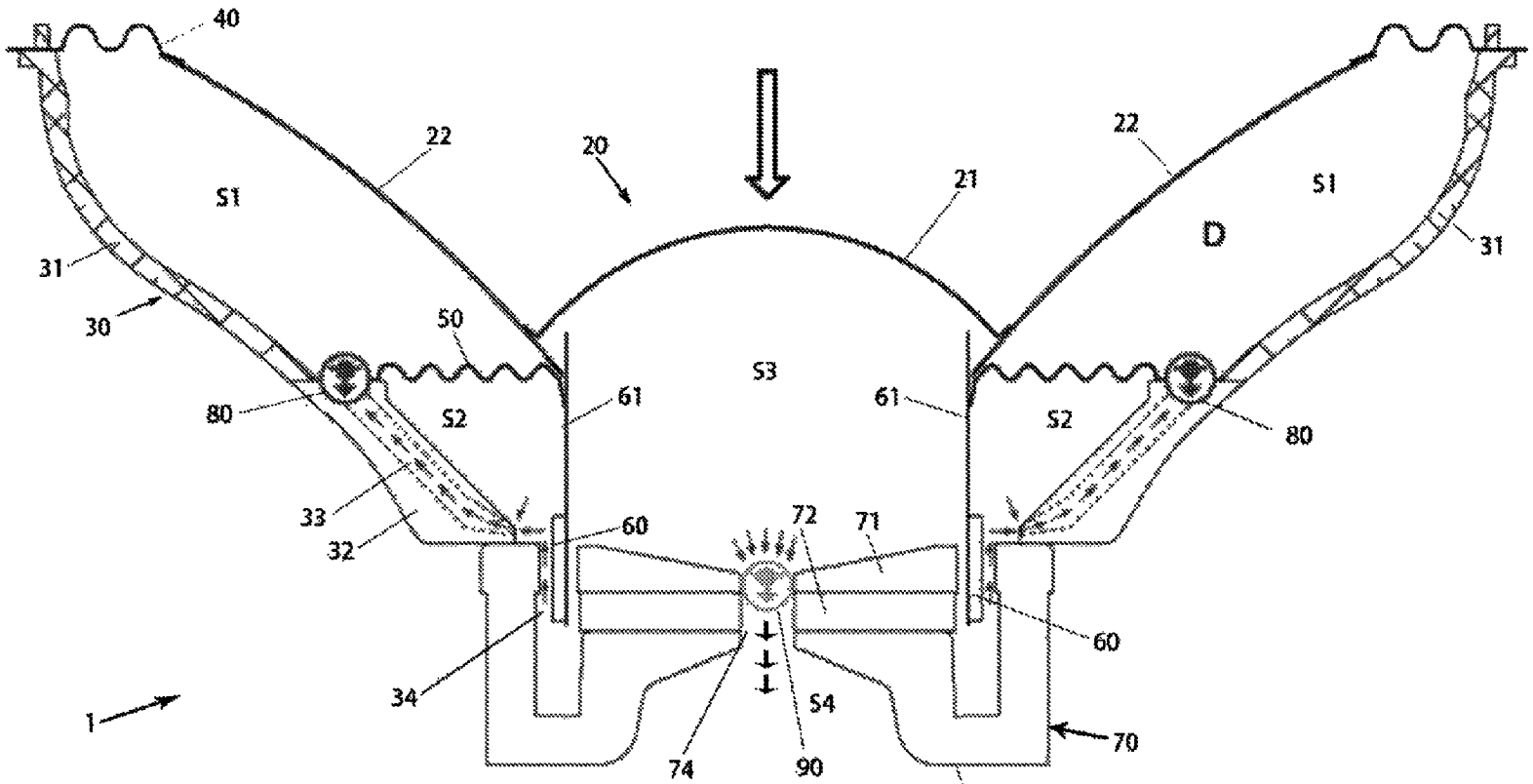
FIG. 3 is a cross-section view of a self-cooling loudspeaker as a diaphragm portion of the loudspeaker during a downward movement in accordance with an embodiment of the invention.

Referring to FIG. 2 and FIG. 3, during sound reproduction, as the diaphragm portion 20 performs the linear movement (respectively shown by the bold arrow), the air molecules around the diaphragm portion 20 are also pushed back and forth. Therefore, the loudspeaker 1 produces airflows in response to these movements. Besides, during the sound reproduction the voice coil 60 becomes the source of heat in the loudspeaker 1. The voice coil 60 heats up as an electric current flows through, and part of the heat is transferred to the air and the elements near the voice coil 60. Therefore, the temperatures of air in the second region S2, the third region S3 and the fourth region S4 are higher than the temperature of air in the first region S1. Taking into account that the temperature in region S4 can be almost the same as S3 since it is in direct contact with the motor assembly as well.

During the upward moves of the loudspeaker 1 as shown in FIG. 2, the cooler air from the first region S1 is pumped in the second air passage 33 to the second region S2 (illustrated by the arrows) in which the voice coil 60 is disposed and then flows through the first air passage 34 to the third region S3. Therefore, the heat produced by the voice coil 60 can be liberated. The cooler air from the first region S1 guided by the second air passage 34 which follows the contour of the second basket 32 of the frame 30, can avoid interfering with or modifying any other elements of the loudspeaker 1. During the upward moves of the loudspeaker 1, the first airflow control member 80 allows air molecules in the first region S1 to flow into the second air passage 33 since the air molecules experience a suction effect being pushed into the second region S2 and the third region S3. That is, as the diaphragm portion 20 rises upward, air pressure is reduced in the second and third regions S2 and S3, and thus air from the first region S1 is drawn through the first airflow control member 80, through the second air passage and into the second region S2 and then is further drawn through the first air passage 34 into the third region S3. Air molecules in the fourth region S4 also experience a suction force into the third region S3 due to the reduction of air pressure therein, however, the second airflow control member 90 blocks access since the second airflow control member 90 only allows the airflow out of the loudspeaker 1.

In a similar method, during the downward moves of the loudspeaker 1 as shown in FIG. 3, hotter air from the second and third regions S2, S3 is pushed out of the loudspeaker 1 into the fourth region S4 (illustrated by the arrows) via the second airflow control member 90 through the central hole 74 of the magnet assembly 70 which serves as a venting hole of the loudspeaker 1. Because the second airflow control member 90 only allows air out of the loudspeaker 1, hotter air stays outside of the loudspeaker 1. Moreover, the airflow that is released through the second airflow control member 80 assists to carry the hot air through the airflow control member 90 into the fourth region S4. There is also some air pushed back into the second air passage 33. But the second air passage 33 is contained by the first airflow control member 80 which prohibits airflow from the second region S2 into the first region S1. In this way, hot air from the second and third regions S2, S3 does not enter the first region S1 from where the cooler air is being taking.

Although two first airflow control members 80 and one airflow control member 90 are used in the embodiment, one skilled in the art can depend on the size of the loudspeaker, number and type of the valves and how much and how efficiently the airflows are wanted to be controlled in order to determine an appropriate number and location of airflow control members.

The present invention is disclosed by the preferred embodiment in the aforementioned description; however, it is contemplated for one skilled at the art that the embodiments are applied only for an illustration of the present invention rather than are interpreted as a limitation for the scope of the present invention. It should be noted that the various substantial alternation or replacement equivalent to these embodiments shall be considered as being covered within the scope of the present invention. Therefore, the protection scope of the present invention shall be defined by the claims.

What is claimed is:

1. A self-cooling loudspeaker comprising:

a frame;

an elastic member connected to the frame;

a diaphragm portion connected to the frame, the diaphragm portion being capable of linear movement, wherein a first region is substantially surrounded by the frame, the elastic member and the diaphragm portion;

a voice coil connected to the diaphragm portion;

a magnet assembly connected to the frame, the magnet assembly having a central opening and a first air passage in which the voice coil is disposed, wherein a second region is substantially surrounded by the voice coil, the elastic member and the frame, a third region is substantially surrounded by the magnet assembly and the diaphragm portion, and a fourth region is at an opposite side of the third region near the magnet assembly;

a first airflow control member connected to the frame and in communication between the first region and the second region, wherein the linear movement of the diaphragm portion produces an airflow and the direction of the airflow is regulated by the first airflow control member from the first region to the second region;

a second airflow control member connected to the central opening of the magnet assembly, wherein the direction of the airflow produced by the linear movement of the diaphragm portion is regulated by the second airflow control member from the third region to the fourth region; and a first basket and a second basket, the first region being surrounded by the first basket, the diaphragm portion, and the elastic member, and the second region being surrounded by the second basket, the elastic member, and the voice coil, wherein a second air passage follows a contour of the second basket.

2. The self-cooling loudspeaker as claimed in claim 1, wherein the first and second airflow control members are one-way air valves.

3. The self-cooling loudspeaker as claimed in claim 1, wherein the first air passage is connected between the second region and the third region.

4. The self-cooling loudspeaker as claimed in claim 1, wherein the central opening of the magnet assembly is the venting hole of the loudspeaker and the second airflow control member is connected thereto.

5. The self-cooling loudspeaker as claimed in claim 1, wherein the second air passage is in the second region.

6. The self-cooling loudspeaker as claimed in claim 1, wherein one end of the second air passage is connected to the first air control member, and the other end of the second air passage is adjacent to the first air passage.

7. The self-cooling loudspeaker as claimed in claim 6, wherein the magnet assembly further comprises a top plate, and wherein the end of the second air passage which is adjacent to the first air passage is near the top plate of the magnet assembly.

* * * * *